US007367078B2

(12) United States Patent
Mameletzi et al.

(10) Patent No.: US 7,367,078 B2
(45) Date of Patent: May 6, 2008

(54) DISPOSAL PLUNGER-BRUSH

(75) Inventors: John Mameletzi, 100 Hollow Branch Rd., Apopka, FL (US) 32703; Mark J. Nuell, Vienna, VA (US)

(73) Assignee: John Mameletzi, Apopka, FL (US)

( * ) Notice: Subject to any disclaimer, the term of this patent is extended or adjusted under 35 U.S.C. 154(b) by 362 days.

(21) Appl. No.: 10/992,666

(22) Filed: Nov. 22, 2004

(65) Prior Publication Data

US 2006/0107476 A1 May 25, 2006

(51) Int. Cl.
*A47L 25/00* (2006.01)

(52) U.S. Cl. ..... 15/105; 15/160; 15/248.1; 4/293; 4/295; D4/116; D4/135; D32/35; D32/42

(58) Field of Classification Search ..... 15/105, 15/160, 248.1; 4/293, 295; D4/116, 130, D4/132, 135; D32/35, 42
See application file for complete search history.

(56) References Cited

U.S. PATENT DOCUMENTS 1,086,676 A * 2/1914 Linscott ..... 401/129
1,437,794 A * 12/1922 Cleveland ..... 4/628
2,496,381 A * 2/1950 Cummings ..... 15/160
D218,728 S * 9/1970 Busse ..... D4/116
3,895,877 A * 7/1975 Fomby ..... 401/129
D288,988 S * 3/1987 Fomby ..... D4/135
5,377,362 A * 1/1995 Jackson ..... 4/292
5,473,782 A * 12/1995 Coakley ..... 4/295
5,617,605 A * 4/1997 Hoerner et al. ..... 15/105
6,047,432 A * 4/2000 Sode ..... 15/160

* cited by examiner

*Primary Examiner*—Mark Spisich
(74) *Attorney, Agent, or Firm*—Birch, Stewart, Kolasch & Birch, LLP

(57) ABSTRACT

A "plunger-brush" is described and claimed. The plunger-brush includes a surface cleaning element at one end of a cylindrical member, which is used to sweep debris from a surface. The cylindrical member also bears a collar that closes a drain opening when the plunger-brush is placed in a drain, for example of a kitchen sink. A handle at the other end of the plunger-brush provides for easy handling of the implement.

11 Claims, 7 Drawing Sheets

DISPOSAL PLUNGER-BRUSH

FIELD OF THE INVENTION

The invention relates to a device used to clean a work surface, principally in a kitchen. The device is used to sweep a surface, typically in a sink, and then to push the debris collected by the sweeping into the drain portion of the sink, especially into a garbage disposal. The device may be left in the disposal unit to serve as a plug to seal the drain when it is desired to fill it.

BACKGROUND OF THE INVENTION

It has come to the attention of the inventor that there is a significant problem in the maintenance of kitchens that food and other materials that accumulate on work surfaces of the kitchen must be collected and disposed of. Frequently, such material is swept into a sink having a garbage disposal unit in the drain. In such instances, the person cleaning the kitchen must often push the material through an opening, which is frequently covered with a flexible, vaned rubber cap, into the disposal unit. The present invention solves the problem of providing a device that integrates the functions of sweeping of debris from surfaces into the drain and of pushing the debris into the disposal unit. The device may also optionally serve as a plug to seal the drain when it is desired to fill a sink.

BRIEF DESCRIPTION OF THE DRAWINGS

The drawings merely illustrate various examples of embodiments of the invention, and are not to be taken as limiting the scope of the invention, which is defined only by the claims hereinbelow.

FIGS. 2A-2C and 2E show exemplary alternative embodiments of a brush as the cleaning means; FIG. 2D and 2F show examples of alternative embodiments of a blade as a cleaning means.

DESCRIPTION OF THE INVENTION

The device of the invention may be called a "plunger brush", in that it performs a function of sweeping of debris from a surface, typically a countertop adjacent to a sink and the sink itself, and thereby accumulating it in the drain of the sink, and then can be used to push the accumulated debris into a garbage disposal unit in the drain. The device includes a collar portion near a handle end and positioned so that the device can be left sitting in the opening of the drain to cap it so that the sink can be filled.

The cylinder can be formed from any material that is commonly used to make kitchen tools. For example, any kind of plastic, rubber, silicone or wood can be used. The cylinder can also be fashioned from a woven rope. In a rope embodiment, the brush can be integrally formed at the first end by adhering or lashing the fibers of the rope at the first end to prevent their fraying, but allowing a short length, from 0.25 to 0.75 inch, of the rope to fray at the first end.

The cylinder can be made by various methods, all well-known in the art, depending of course upon the material chosen to form it. For example, a wood cylinder can be formed on a lathe or cut from a pre-formed dowel. A plastic or rubber cylinder can be formed by injection molding or by extrusion. A metal cylinder can be cut from a rod, cast, or extruded.

Figure 1:
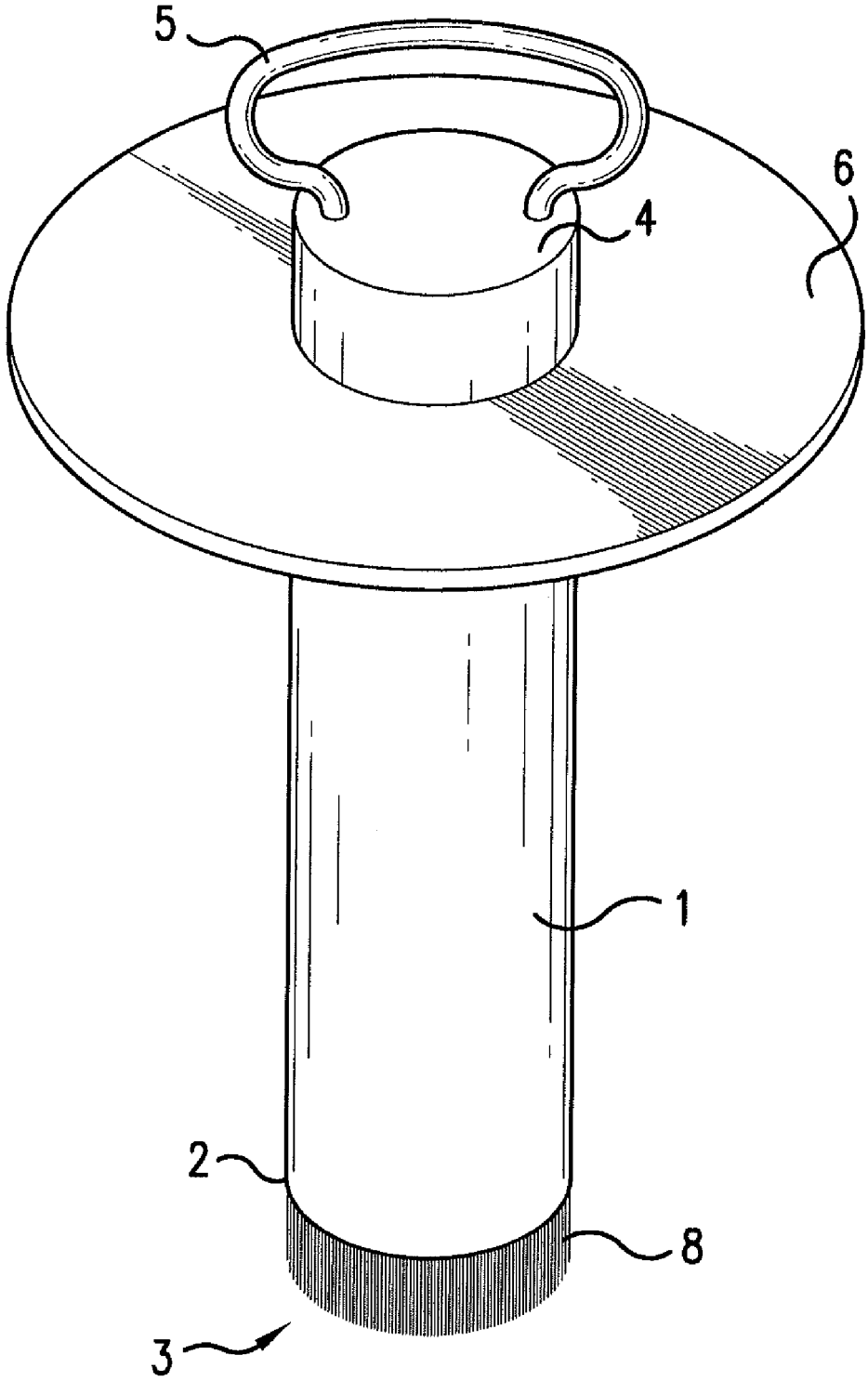
FIG. 1 shows an embodiment of the invention in which the cleaning means is integral with the cylinder.
Figure 2A:
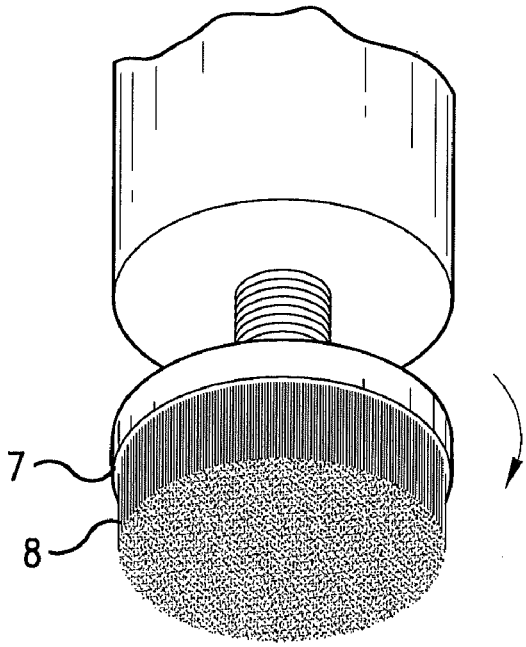
FIGS. 2A-2F show exemplary embodiments of the invention in which the cleaning means is provided in a cleaning head that is separable from the cylinder.
Figure 2B:
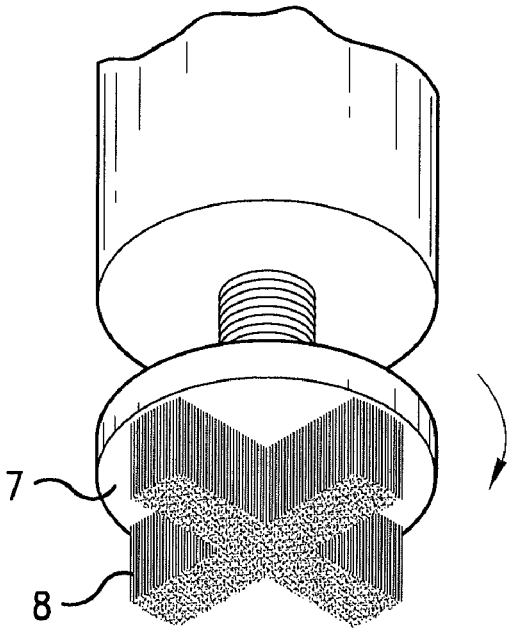
Figure 2C:
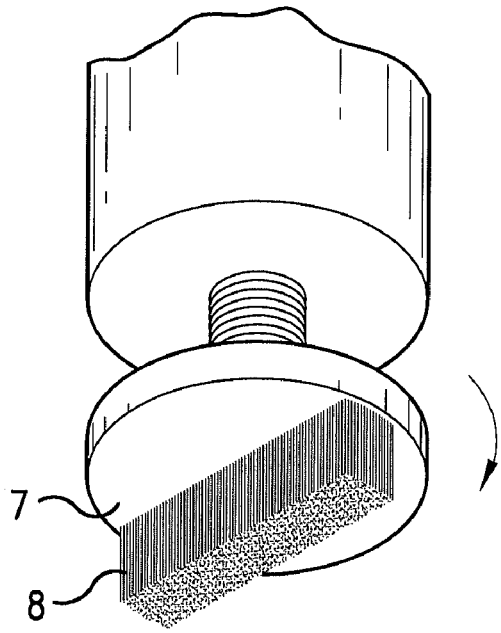
Figure 2D:
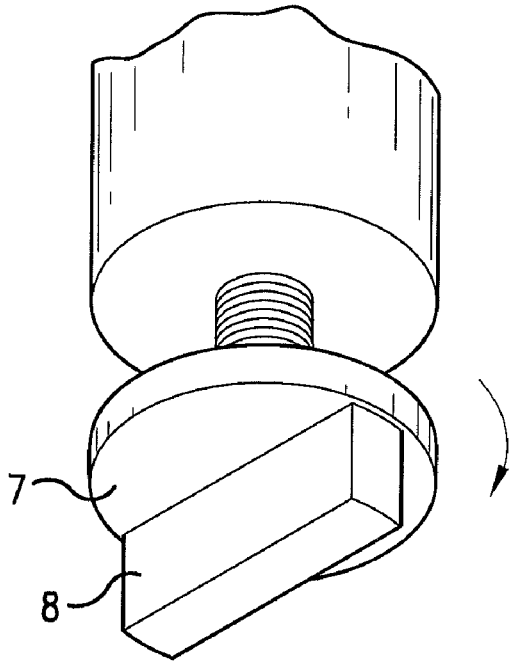
Figure 2E:
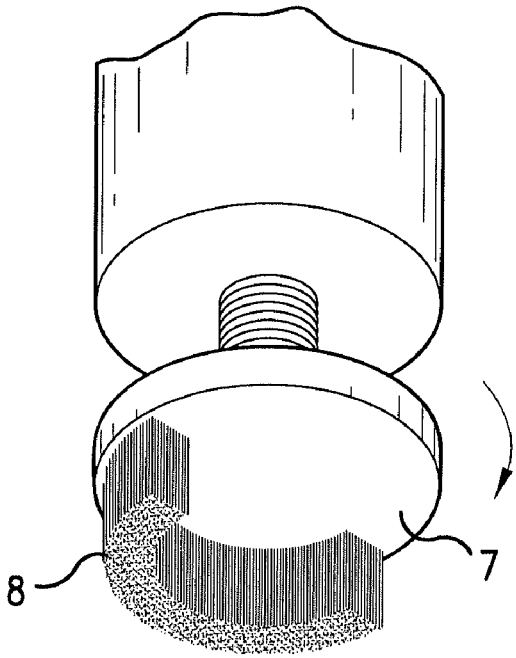
Figure 2F:
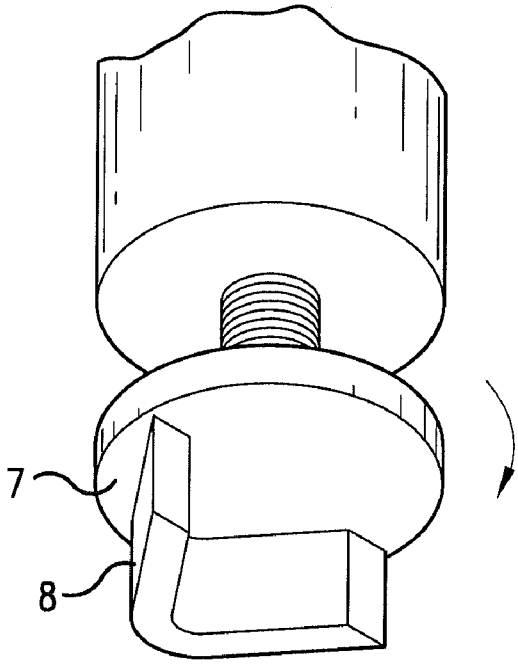

A means for cleaning a surface (3) by sweeping motion is attached to the first end of the cylinder. Such means is typically a brush of some sort, or a flexible blade such as would be found on a squeegee, spatula or other sort of a wiping blade. Referring to FIG. 2A, the cleaning means will typically comprise a "head" (7) that attaches the cleaning means to the cylinder and into which a sweeping means (8) typically bristles or a blade, are set. However, as explained elsewhere herein, either or both the head and the sweeping means can be integrally formed with the cylinder.

If a blade embodiment is used, it should be flexible enough to conform to a slightly curved surface, such as is typically found at the bottom of a sink, but should have sufficient rigidity to be able to remove slight adhered material from a surface by a scraping motion. The blade may be fashioned from any common rubber or silicone or plastic as is typical in the art.

A blade should be from 0.5 to 1 inch in width and typically would extend across the entire diameter of the cylinder. A plurality of blades may be used, arranged in a parallel fashion or shaped into a line having a concavity, such as a half-circle or a V-shape, not necessarily at the circumference of the cylinder or cleaning head.

A brush is a preferred embodiment of a cleaning means. The manufacture of brushes is considered well-known in the art, and the typical materials can be used for the brush. A preferred embodiment utilizes plastic bristles that are set into holes in a head, or in the first end of the cylinder, to arrange them. Another preferred embodiment the bristles are formed by injection molding of the head and bristles together. In this latter embodiment, the head of the brush may be constituted by or integrally formed with the cylinder portion of the device.

Plastics are preferred materials for the brush bristles. The material is preferably one that is water resistant and can be easily cleaned.

The bristles can be arranged in any design, but a line or a plurality of lines of bristles, or an arrangement in which they are arranged to uniformly cover the first end of the cylinder, are preferred. A plurality of lines of bristles may be arranged either in parallel, or two lines may be formed into a cross. A circle of bristles may be formed around the circumference of the cylinder. The bristles may be arranged in a concave shape, such as a half-circle or V-shape, not necessarily at the circumference. A concave shape provides an advantage of collecting the material that is swept up into a small area.

The sweeping means can be attached to the cylinder in a removable fashion, or can be integrally formed with the cylinder. Integral attachment is most easily accomplished by manufacturing the device and forming it using injection molding or other molding methods. Integral attachment can also be achieved by making the device from some sort of woven fiber, fixing a bundle of fibers at the first end to prevent their fraying, but allowing a short length of fibers to remain frayed, thus forming a brush.

Bristles of a brush should be from 0.125 to 1 inch long, preferably from 0.25 to 0.375, 0.5 or to 0.75 inches long. The diameter of the bristles is not critical, but the bristles should be thick enough to have a semi-stiff character sufficient to allow wet, slightly adherent materials to be easily swept along.

The cleaning means may be permanently attached to the cylinder, e.g. by use of an adhesive. Alternatively, the cleaning means can be built into the cylinder, for example by inserting brush bristles into holes in the first end of the cylinder, or by inserting blades into slots in the first end of the cylinder.

Figure 3A:
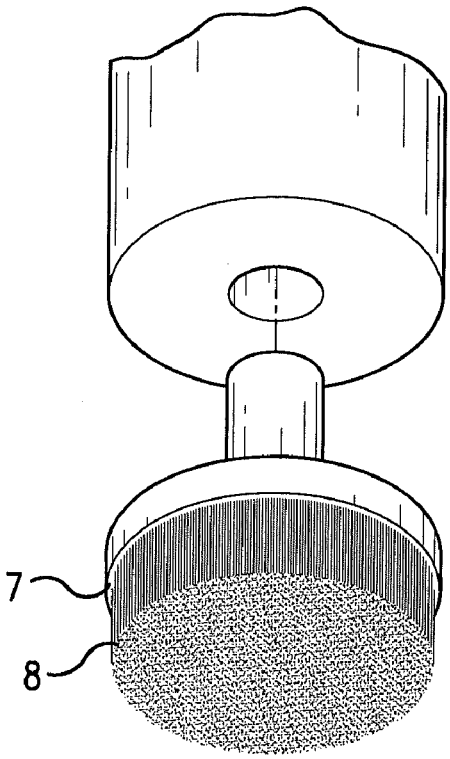
FIGS. 3A and 3B show examples of alternative ways to attach the cleaning head to the cylinder.
Figure 3B:
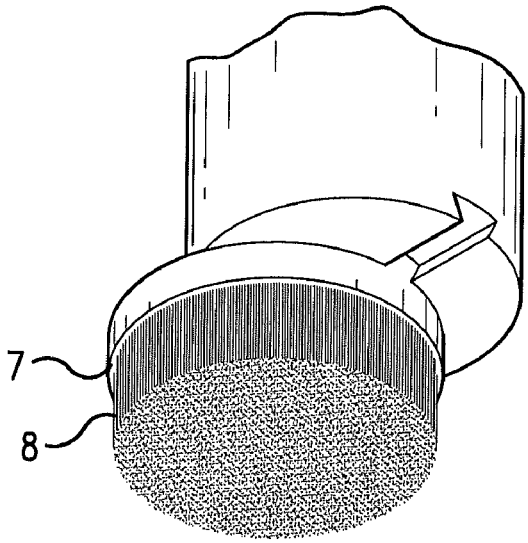
Figure 4A:
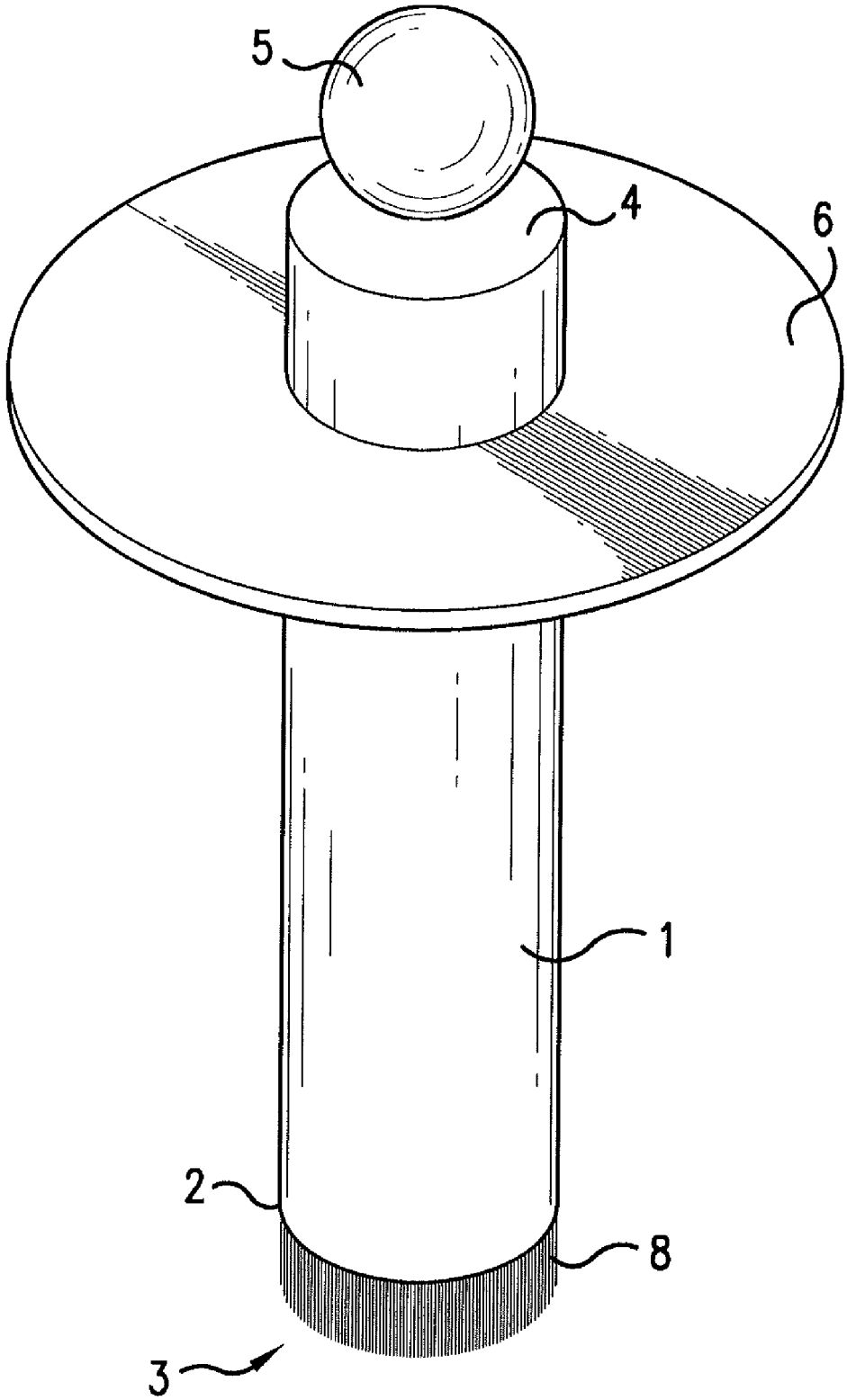
FIGS. 4A and 4B show examples of alternative embodiments of the handle portion of the invention.
Figure 4B:
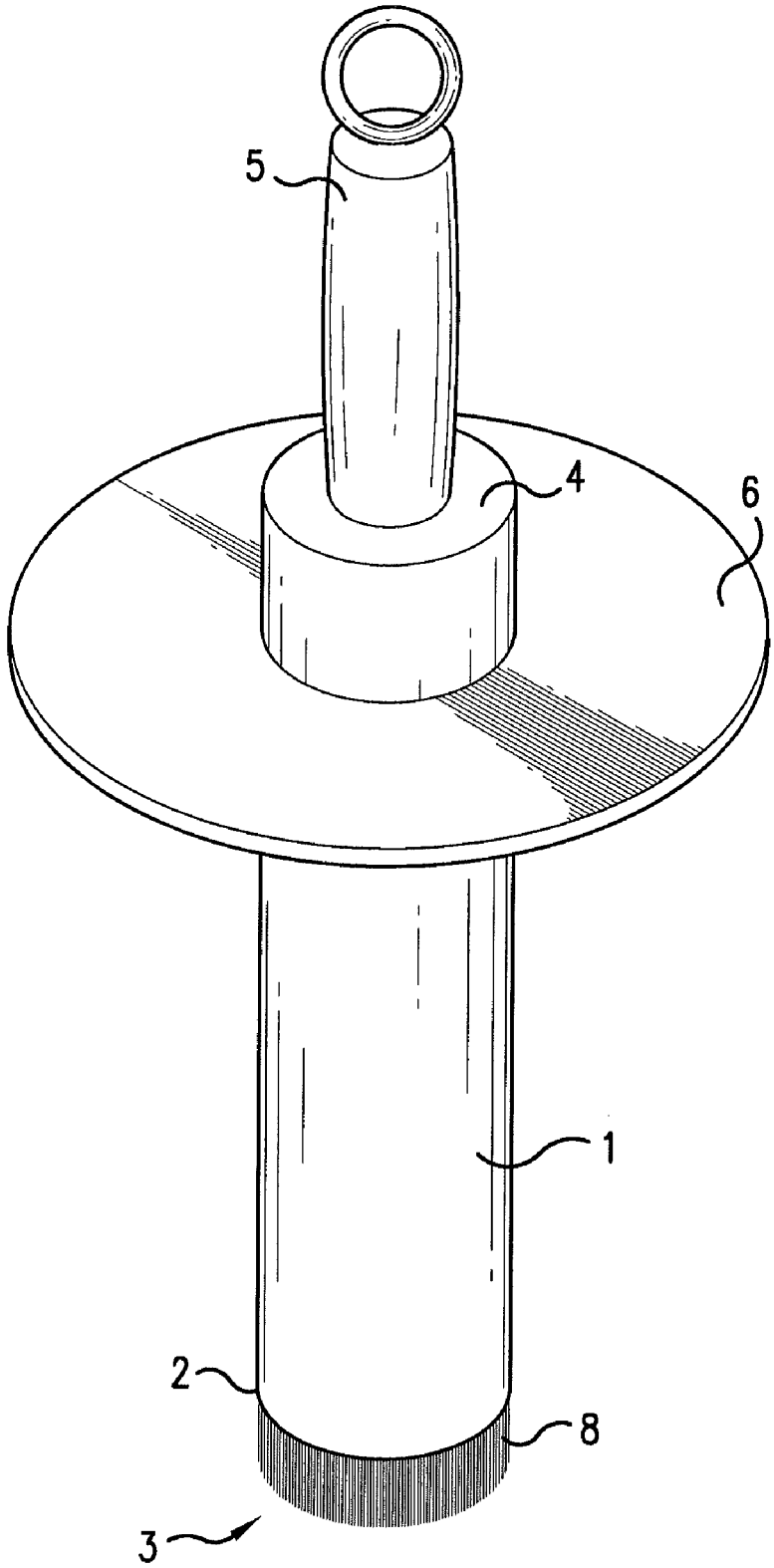
Figure 5:
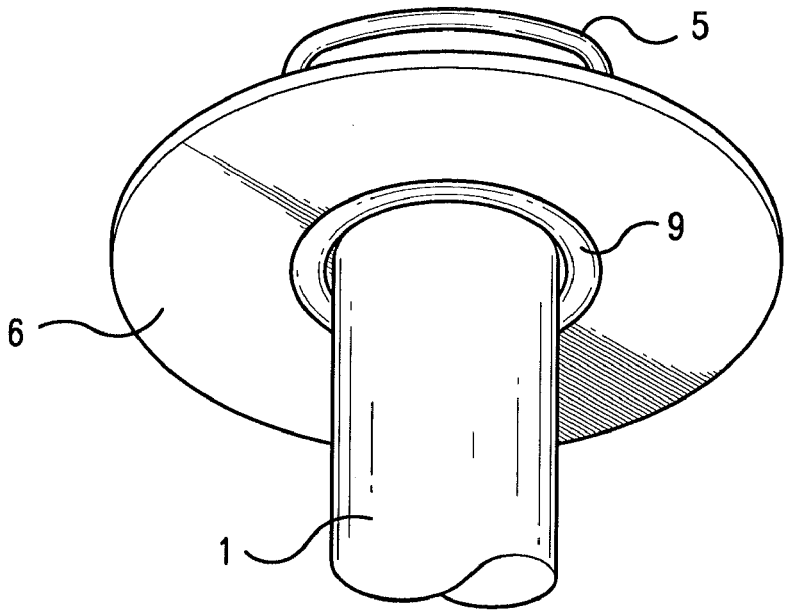
FIG. 5 shows one location of the gasket (9).
Figure 6A:
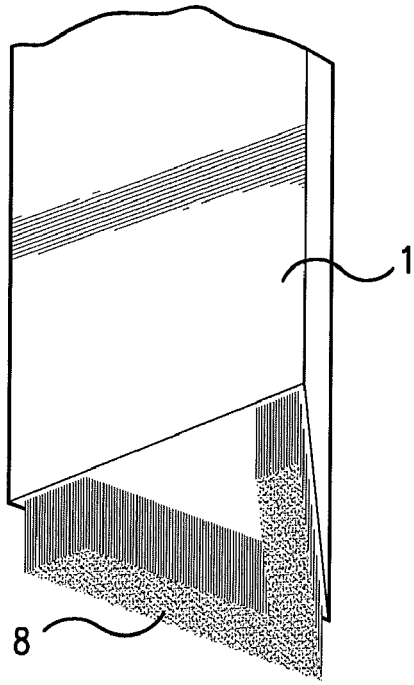
FIGS. 6A and 6B illustrate one polygonal cross section and a semi-circular cross section of the cylinder.
Figure 6B:
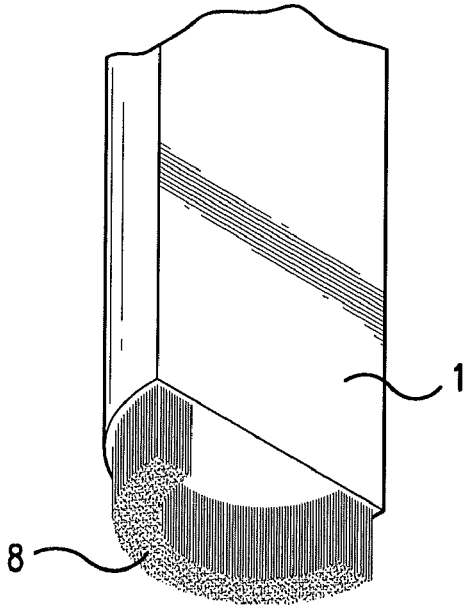

The cleaning means may alternatively be removably attached to the cylinder by any of the ways common in the art. For example, one or more screws may be run though the head portion into the cylinder. Alternatively, one or more pegs may be formed on the head of the cleaning means (see FIG. 3A) that is fit into corresponding holes in the cylinder, or vice-versa. As a further alternative, a tongue-in-groove arrangement may be used, so that the head of the cleaning means slides onto the cylinder (FIG. 3B). In yet another embodiment, the circumference of the cleaning head can be made either slightly larger than the cylinder (or slightly smaller if the cylinder has a hollow first end) and then can be pressure fit or "snapped on" to the end of the cylinder.

A handle for holding the device and using it in a sweeping motion (5) is attached at the second end of the cylinder. The holding means may also be integrally formed with the cylinder, indeed the top part of the cylinder itself can be the handle. Alternatively the handle can be made as a separate piece and then attached, for example by a screw or bolt or rivet, or by a peg or by an adhesive. Again, any material commonly used in making kitchen tools can be used to make the handle. The handle is preferably made from a rigid plastic to facilitate cleaning of the article. Fashioning the handle and the cylinder from a brushed metal, such as steel or aluminum, provides an item having an "upscale" appearance.

The shape of the handle can be any one that is convenient and comfortable. For example, a ball shape or an elongated, round shape, similar to the handle of a rolling pin, is easy to grip and use for sweeping. A loop shape is also easy to handle and also provides a way to store the device by hanging it by the loop. A loop can be placed on top of another shape selected for the handle.

The handle can be covered with a slip resistant material, or can be textured to provide for firm gripping.

The handle should fit comfortably in one's hand and so should be at least about 0.75 inches in diameter. A ball shaped handle might be somewhat larger, as much as 2 to 3 inches in diameter. If an elongated handle is chosen, it might be from 4 to 6 inches long and from 0.5 to 1.5 inches in diameter.

The overall length of the article from the top of the cylinder to the end of the cleaning means is from about 4 inches to about 6.5 inches.

At some point along its length, the cylinder bears "collar (6)" that is shaped as a relatively thin disk. The disk is preferably round, but for asthetic reasons, might be shaped the same as the cylinder. The collar is preferably placed at the top one-half of the length of the cylinder, more preferably within the top one-quarter of the length of the cylinder, still more preferably within the top one-eighth of the length of the cylinder, at a height that allows the article to rest in the drain and clear the disposal mechanism when set into the drain. Thus, the collar should be placed so that no more than 6 inches, typically between 4 and six inches, of the length of the cylinder plus the cleaning means extends below the bottom surface of the collar.

The diameter of the collar is at least 3.5 inches, and preferably is less than 5.5 inches. Typically the collar is from 4 to 5 inches in diameter so as to cover a standard drain opening. The thickness of the collar is not critical and is preferably from 0.125 to 0.5 inches, preferably from 0.125 to 0.25 inches.

The collar may be made of any material typically used to fashion kitchen tools. The collar is preferably made of a rigid material, as it must support the article in the drain and, if the collar is too flexible, then the article may fall into the drain. Also for this reason, the collar is preferably permanently attached to the cylinder. For example, an adhesive may be used to affix the collar to the cylinder, especially if the article is made from wood.

The collar may be made of a somewhat flexible plastic or rubber or silicone, so that the weight of the article when resting in a drain can pull the collar tight against the surface of a sink to form a seal, allowing the sink to fill with water.

In embodiments where it is deemed desirable that the item not be used as a drain plug, or that the article pass water into a drain while resting in the drain, the collar may be omitted or may be made of a perforated or mesh material.

The collar can be integrally formed with the cylinder, for example by molding the article from plastic or rubber, or by casting it from metal.

As an alternative embodiment in which sealing of the drain by resting the article in it is desired, the cylinder below the collar, or the underside of the collar, may be fixed with a gasket (9) or the like to provide a tight seal of the cylinder to the drain or of the collar to the surface of the sink (or both) when the article is resting in the drain to serve as a plug. Such a gasket can be made from a rubber or silicone "O-ring" or the like. In instances where the gasket is attached to the bottom of the collar, the gasket is typically fashioned from a relatively soft material that can deform to form a seal between the surface of the sink and the bottom of the collar under the weight of the plunger brush. The gasket is preferably held in place by an adhesive.

In instances where the article as a whole, or at least the collar, is made by molding from a rubber or silicone composition, the gasket may be integrally formed on the underside of the collar or at the joint of the collar and the cylinder. In embodiments where the cylinder is round in cross section, the gasket can take the form of a thickening of the cylinder below the collar, for example in a trapezoidal cross section in the manner that a rubber cork is typically shaped.

What is claimed is:

1. A plunger brush comprising:

a) an elongated cylinder having a first end and a second end;

b) a substantially planar cleaning head having upper and lower surfaces, said cleaning head further having a size and shape this is substantially identical to that of the cross-section of the cylinder, said upper surface including a means for removably coupling the cleaning head to the first end of the cylinder and said lower surface including a cleaning means in the form of a brush or at least one blade;

c) a handle being disposed at the second end of the cylinder; and d) a collar disposed between the handle and the first end along the one-half of the cylinder proximal to the second end.

2. The plunger brush of claim 1, further comprising a gasket that is attached to the cylinder or to the underside of the collar that is effective to seal a drain into which the plunger brush is placed.

3. The plunger brush of claim 2, in which the cylinder is formed of a rubber or silicone material and the gasket is formed by thickening of the cylinder at the joint of the collar.

4. The plunger brush of claim 1, in which the collar is integrally formed with the cylinder.

5. The plunger brush of claim 1, in which the cleaning head comprises a brush.

6. The plunger brush of claim 1, in which the cleaning head is removably attached to the first end of the cylinder by a screw, at least one peg in at least one hole or by a tongue-in-groove.

7. The plunger brush of claim 1, in which the cylinder has a polygonal cross section.

8. The plunger brush of claim 1, in which the cleaning means is a brush composed of bristles.

9. The plunger brush of claim 1, in which the cleaning means is one or more flexible blades.

10. The plunger brush of claim 1, in which the cleaning head comprises a brush or at least one blade, arranged in a shape having a concavity.

11. The plunger brush of claim 10, in which the shape having a concavity is a half-circle or a V-shape.

* * * * *